US005498287A

United States Patent [19]

Barnfield

[11] Patent Number: 5,498,287

[45] Date of Patent: Mar. 12, 1996

[54] APPARATUS FOR SUPPORTING A FLUID AND TAPE TO BE DISPENSED FOR SEALING SEAMS OF WALLBOARD PANELS

[76] Inventor: Ronald Barnfield, 11B Karen La., Londonderry, N.H. 03053

[21] Appl. No.: 257,171

[22] Filed: Jun. 9, 1994

[51] Int. Cl.[6] ..... B05C 3/172

[52] U.S. Cl. ..... 118/43; 118/123; 118/405; 118/419; 118/423; 156/575

[58] Field of Search ..... 118/40, 43, 123, 118/405, 419, 423; 156/575, 579

[56] References Cited

U.S. PATENT DOCUMENTS

| | | | |
|---|---|---|---|
| 2,540,697 | 2/1951 | Staples | 118/43 |
| 1,774,042 | 8/1930 | Stover | 118/43 |
| 2,574,942 | 11/1951 | Vachon | 118/123 |
| 2,679,232 | 5/1954 | Brown | 118/43 |
| 2,746,546 | 5/1956 | Taylor | 118/43 |
| 2,858,953 | 11/1958 | Harrell | 156/575 |
| 2,876,730 | 3/1959 | Moore | 118/43 |
| 3,023,728 | 3/1962 | Ort | 118/43 |
| 3,112,225 | 11/1963 | Harns | 118/123 |
| 3,260,577 | 7/1966 | Mayhew | 118/123 |
| 3,342,160 | 9/1967 | Weeks | 118/43 |
| 3,496,909 | 2/1970 | Bennett | 118/43 |
| 3,669,070 | 6/1972 | Wallace | 118/123 |
| 3,913,522 | 10/1975 | Light | 118/43 |
| 3,923,003 | 12/1975 | Carden | 118/405 |
| 3,979,242 | 9/1971 | Holland et al. | 118/575 |
| 4,202,288 | 5/1980 | Davy | 118/123 |
| 4,757,783 | 7/1988 | Matheny | 118/419 |
| 4,996,941 | 3/1991 | Mills | 156/575 |
| 5,242,495 | 9/1993 | Hammond et al. | 118/40 |

*Primary Examiner*—Peter Kratz

[57] ABSTRACT

An apparatus for supporting a fluid and tape to be dispensed for sealing seams of wallboard panels comprising a bucket adapted to support a roll of tape and a quantity of a blending fluid; support mechanisms including a central shaft formed of two co-axial parts with a spring urging the parts axially outward thereof, a pair of upper bosses secured to the interior surface of the side wall of the bucket adjacent to the upper edge thereof with apertures receiving the opposed ends of the support rod and with the roll of tape supported at the central extent of the support rod; a guide rod rotatably secured in a lower extent of the bucket, the guide rod having opposed ends, a pair of lower bosses secured to the interior surface of the side wall of the bucket adjacent to the lower edge thereof with apertures receiving the opposed ends of the guide rod, the guide rod positioned to receive and guide tape extending from the support rod; and a slot in a generally horizontal orientation positioned through a lower extent of the side wall, the slot being at an elevational location essentially that of the lower most edge of the guide rod, the aperture having a support block with a slot formed as an extension of the primary slot and secured to the bucket on the exterior surface thereof, the slot having exteriorly thereof a finger formed with a cutting edge extending upwardly into the lower surface of the path of travel of tape being fed through the aperture, the block also having a downwardly extending brush contactable with the upper surface of the tape being fed therethrough for smoothing the blending agent thereon.

1 Claim, 4 Drawing Sheets

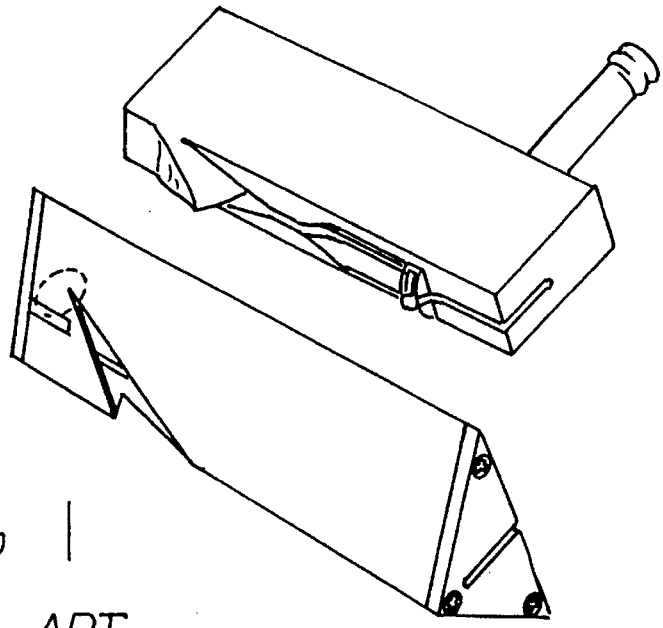
FIG 1
PRIOR ART
FIG 2
PRIOR ART
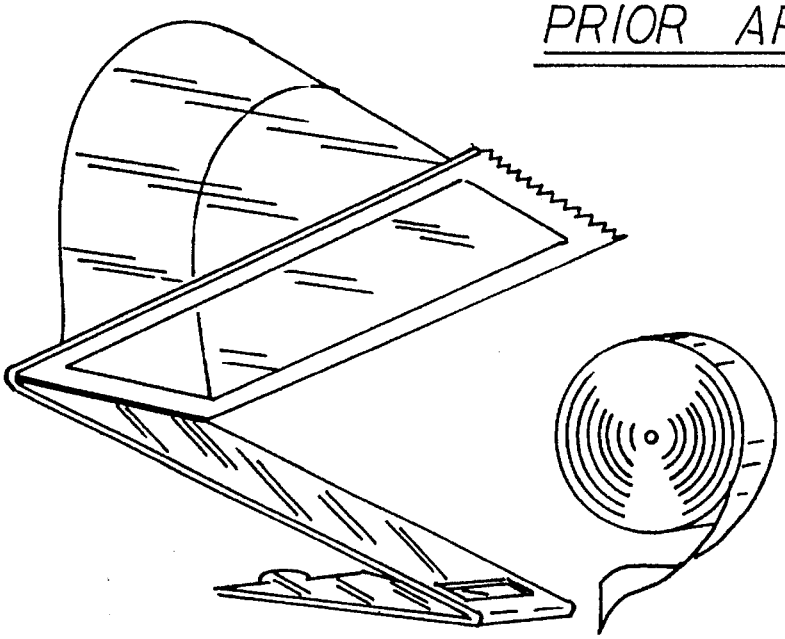

FIG 5
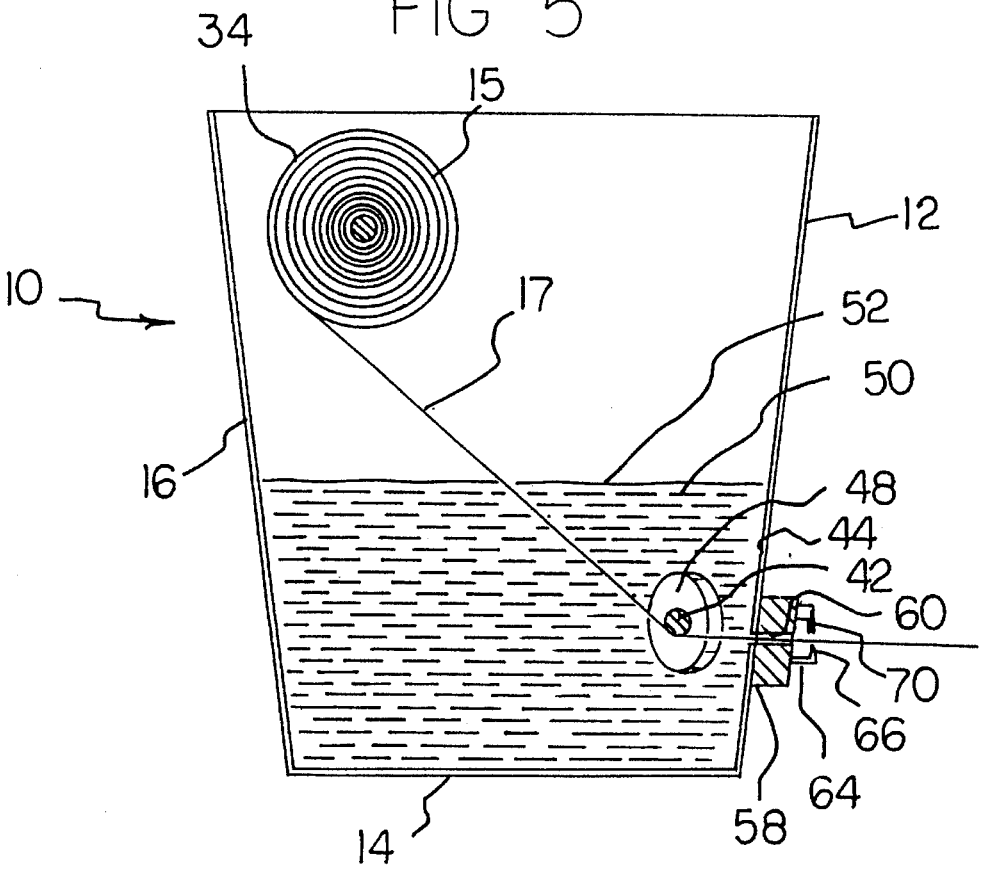
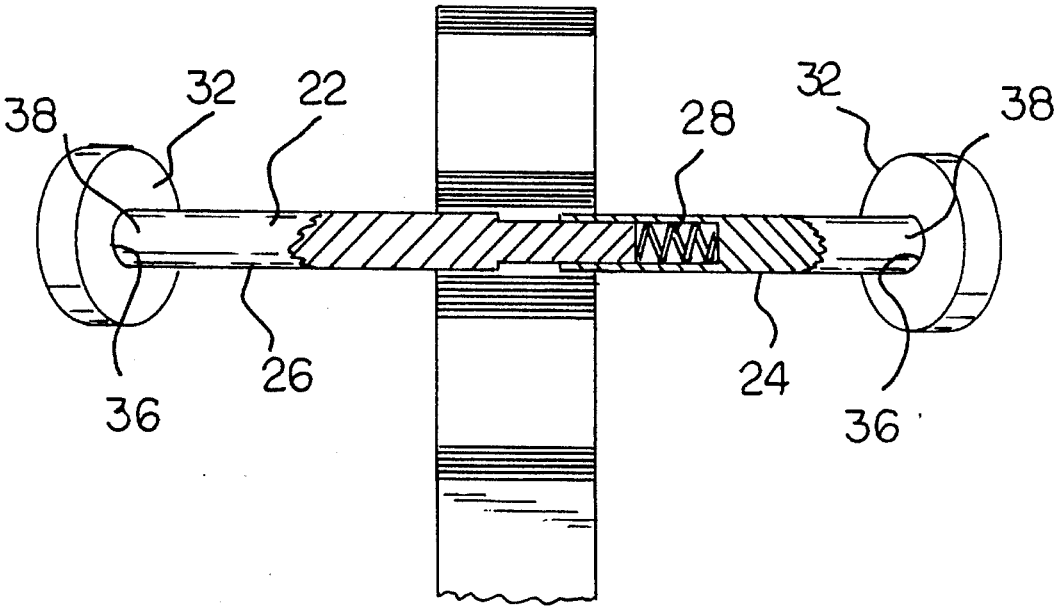
FIG 6

APPARATUS FOR SUPPORTING A FLUID AND TAPE TO BE DISPENSED FOR SEALING SEAMS OF WALLBOARD PANELS

BACKGROUND OF THE INVENTION

1. Field of the Invention

The present invention relates to an apparatus for supporting a fluid and tape to be dispensed for sealing seams of wallboard panels and more particularly pertains to supporting a blending agent and tape in a bucket and dispensing the tape coated with the blending agent for use in sealing and blending the seams of wallboard panels.

2. Description of the Prior Art

The use of buckets, tape dispensers and various techniques for sealing and blending the seams of wallboard panels is known in the prior art. More specifically, buckets, tape dispensers and various techniques for sealing and blending the seams of wallboard panels heretofore devised and utilized for the purpose of sealing and blending the seams of wallboard panels with a wide variety of devices and mechanisms are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,707,427 to Erickson discloses a dispensing gun for wallboard tape and joint compound.

U.S. Pat. No. 4,090,914 to Hauk discloses an apparatus for applying tape and adhesive to wallboard joints.

U.S. Pat. No. 4,689,107 to Entwistle and U.S. Pat. No. 4,775,442 to Januska disclose an applicator for wallboard tape.

Lastly, U.S. Pat. No. 5,137,752 to Mills discloses a gypsum wallboard taping system.

In this respect, the apparatus for supporting a fluid and tape to be dispensed for sealing seams of wallboard panels according to the present invention substantially departs from the conventional concepts and designs of the prior art, and in doing so provides an apparatus primarily developed for the purpose of supporting a blending agent and tape in a bucket and dispensing the tape coated with the blending agent for use in sealing and blending the seams of wallboard panels.

Therefore, it can be appreciated that there exists a continuing need for a new and improved apparatus for supporting a fluid and tape to be dispensed for sealing seams of wallboard panels which can be used for supporting a blending agent and tape in a bucket and dispensing the tape coated with the blending agent for use in sealing and blending the seams of wallboard panels. In this regard, the present invention substantially fulfills this need.

SUMMARY OF THE INVENTION

In view of the foregoing disadvantages inherent in the known types of buckets, tape dispensers and various techniques for sealing and blending the seams of wallboard panels now present in the prior art, the present invention provides an improved apparatus for supporting a fluid and tape to be dispensed for sealing seams of wallboard panels. As such, the general purpose of the present invention, which will be described subsequently in greater detail, is to provide a new and improved apparatus for supporting a fluid and tape to be dispensed for sealing seams of wallboard panels and method which has all the advantages of the prior art and none of the disadvantages.

To attain this, the present invention essentially comprises a new and improved apparatus for supporting a fluid and tape to be dispensed for sealing seams of wallboard panels comprising, in combination, a bucket having a lower flat base and an upstanding generally cylindrical side wall with a handle rotatably secured with respect to the upper edge thereof; a roll of tape to be dispensed from the bucket; mechanisms for supporting the roll of tape, such support mechanisms including a central shaft formed of two co-axial parts with a spring urging the parts axially outward thereof, a pair of upper bosses secured to the interior surface of the side wall of the bucket adjacent to the upper edge thereof with apertures receiving the opposed ends of the support rod and with the roll of tape supported at the central extent of the support rod; a guide rod rotatably secured in a lower extent of the bucket, the guide rod having opposed ends, a pair of lower bosses secured to the interior surface of the side wall of the bucket adjacent to the lower edge thereof with apertures receiving the opposed ends of the guide rod, the guide rod positioned to receive and guide tape extending from the support rod; a quantity of a blending fluid in the bucket to an elevation between the guide rod and roll of tape; and a slot in a generally horizontal orientation positioned through a lower extent of the side wall, the slot being at an elevational location essentially the same as that of the lower most edge of the guide rod, the slot having a support block with an aperture formed as an extension of the slot and secured to the bucket on the exterior surface thereof, the aperture having exteriorly thereof a finger formed with a cutting edge extending upwardly from beneath the aperture into the lower surface of the path of travel of tape being fed through the slot and aperture, the block also having a brush extending downwardly and contactable with the upper surface of the path of travel of the tape being fed through the slot for smoothing the blending fluid thereon whereby tape from a roll on the support rod may be fed therefrom and diverted by the guide rod and directed in the horizontal path of travel through the slot and aperture into contact with the brush and, when necessary, the cutting blade.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for supporting a fluid and tape to be dispensed for sealing seams of wallboard panels which has all the advantages of the prior art buckets, tape dispensers and various techniques for sealing and blending the seams of wallboard panels and none of the disadvantages.

It is another object of the present invention to provide a new and improved apparatus for supporting a fluid and tape to be dispensed for sealing seams of wallboard panels which may be easily and efficiently manufactured and marketed.

It is a further object of the present invention to provide a new and improved apparatus for supporting a fluid and tape to be dispensed for sealing seams of wallboard panels which is of durable and reliable constructions.

An even further object of the present invention is to provide a new and improved apparatus for supporting a fluid and tape to be dispensed for sealing seams of wallboard panels which is susceptible of a low cost of manufacture with regard to both materials and labor, and which accordingly is then susceptible of low prices of sale to the consuming public, thereby making such apparatus for supporting a fluid and tape to be dispensed for sealing seams of wallboard panels economically available to the buying public.

Still yet another object of the present invention is to provide a new and improved apparatus for supporting a fluid and tape to be dispensed for sealing seams of wallboard panels which provide in the apparatuses and methods of the prior art some of the advantages thereof, while simultaneously overcoming some of the disadvantages normally associated therewith.

Even still another object of the present invention is to support a blending agent and tape in a bucket and dispense the tape coated with the blending agent for use in sealing and blending the seams of wallboard panels.

Lastly, it is an object of the present invention to provide a new and improved apparatus for supporting a fluid and tape to be dispensed for sealing seams of wallboard panels comprising a bucket having a lower flat base and an upstanding generally cylindrical side wall with a handle rotatably secured with respect to the upper edge thereof, the bucket adapted to support a roll of tape and a quantity of a blending fluid; mechanisms for supporting the roll of tape to be dispensed, such support mechanisms including a central shaft formed of two co-axial parts with a spring urging the parts axially outward thereof, a pair of upper bosses secured to the interior surface of the side wall of the bucket adjacent to the upper edge thereof with apertures receiving the opposed ends of the support rod and with the roll of tape supported at the central extent of the support rod; a guide rod rotatably secured in a lower extent of the bucket, the guide rod having opposed ends, a pair of lower bosses secured to the interior surface of the side wall of the bucket adjacent to the lower edge thereof with apertures receiving the opposed ends of the guide rod, the guide rod positioned to receive and guide tape extending from the support rod; and a slot in a generally horizontal orientation positioned through a lower extent of the side wall, the slot being at an elevational location essentially that of the lower most edge of the guide rod, the aperture having a support block with a slot formed as an extension of the primary slot and secured to the bucket on the exterior surface thereof, the slot having exteriorly thereof a finger formed with a cutting edge extending upwardly into the lower surface of the path of travel of tape being fed through the aperture, the block also having a downwardly extending brush contactable with the upper surface of the tape being fed therethrough for smoothing the blending agent thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a prior art system for sealing and blending the seams of wallboard panels.

FIG. 2 is another prior art technique for sealing and blending the seams of wallboard panels.

FIG. 5 is a cross-sectional view taken along line 5—5 of FIG. 4.

FIG. 6 is a cross-sectional view taken along line 6—6 of FIG. 5.

The same reference numerals refer to the same parts through the various Figures.

DESCRIPTION OF THE PREFERRED EMBODIMENT

Figure 3:
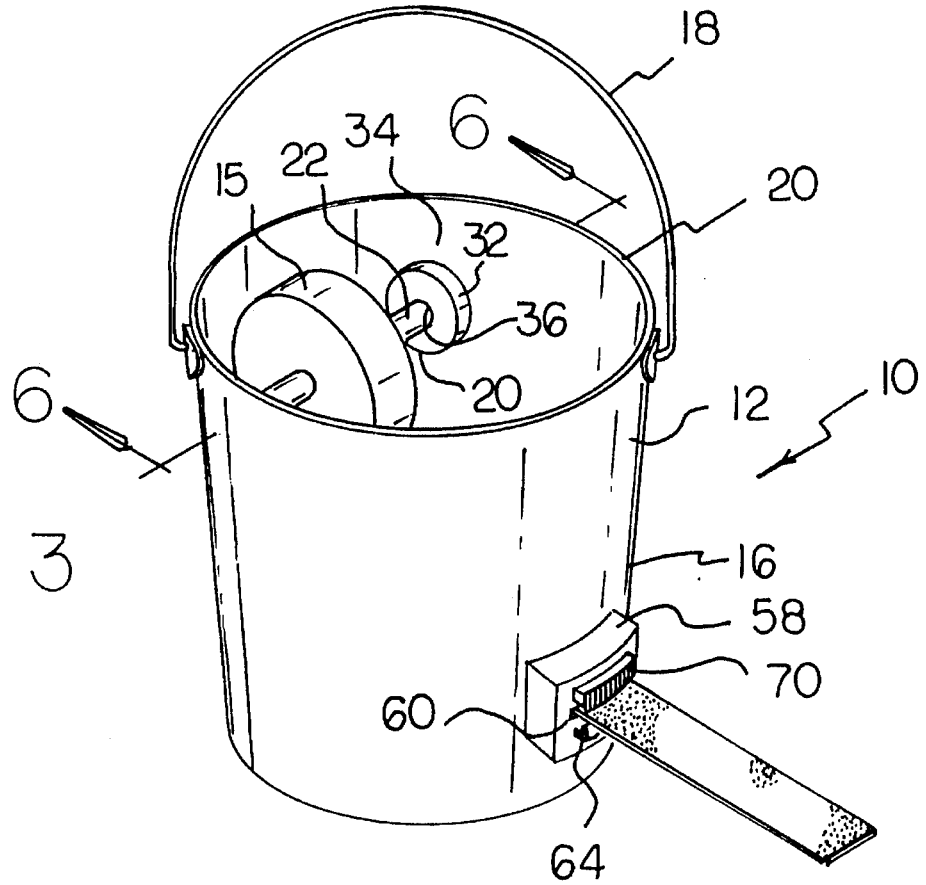
FIG. 3 is a perspective illustration of the preferred embodiment of the new and improved apparatus for supporting a fluid and tape to be dispensed for sealing seams of wallboard panels constructed in accordance with the principles of the present invention.
Figure 4:
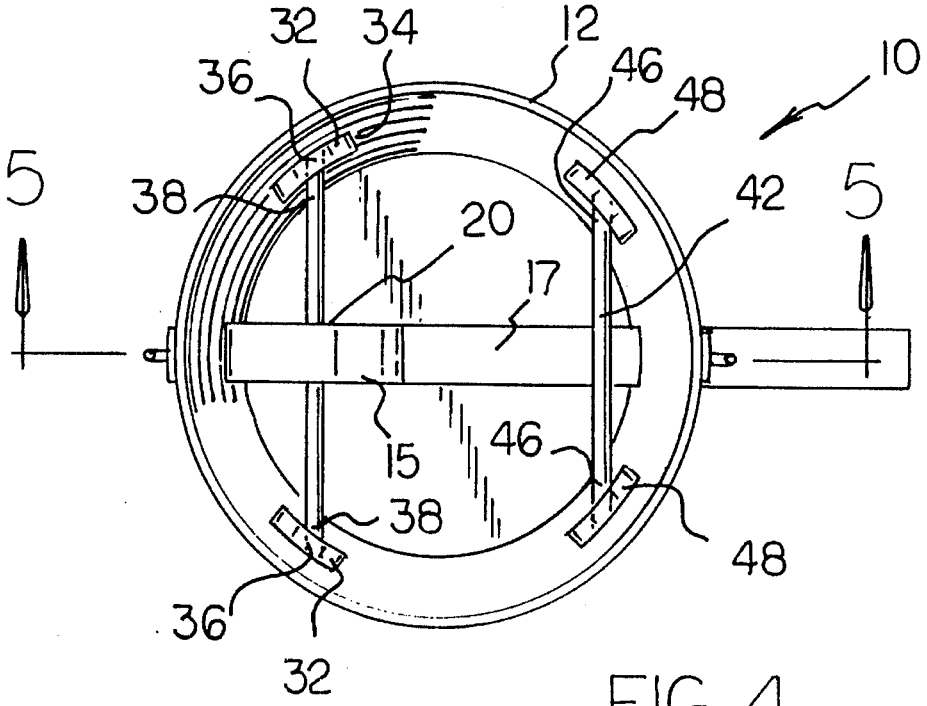
FIG. 4 is a top elevational view of the device shown in FIGS. 3.
Figure 7:
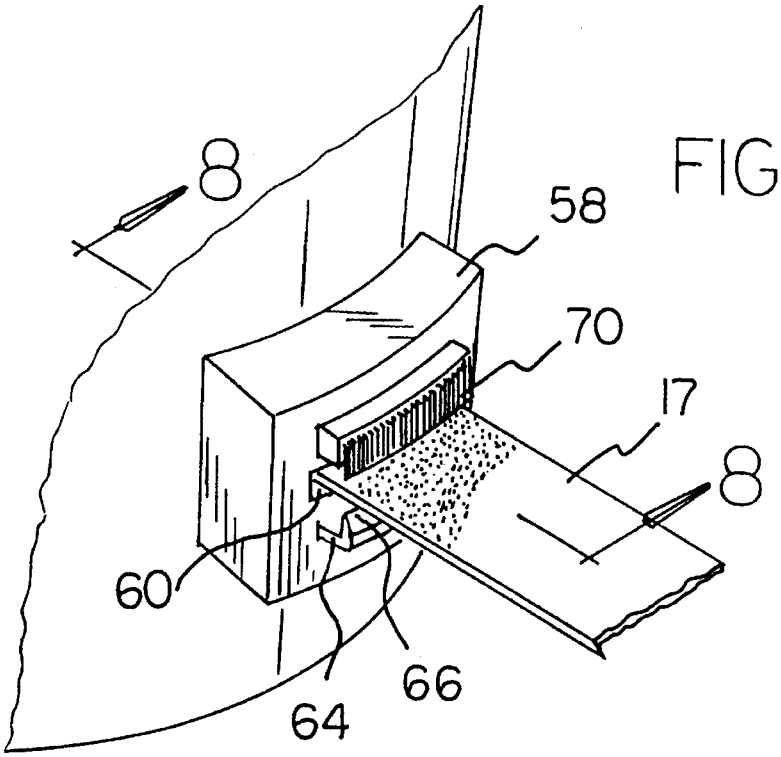
FIG. 7 is an enlarged perspective view of the dispensing slot of the device shown in FIGS. 3 and 5.
Figure 8:
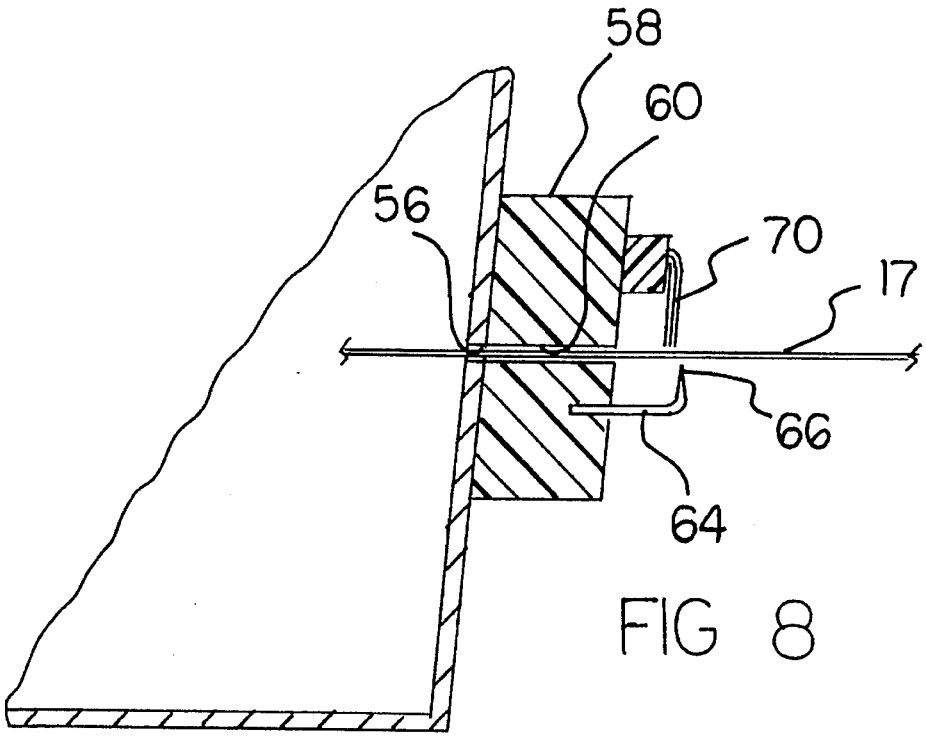
FIG. 8 is a cross-sectional view taken along line 8—8 of FIG. 7.

With reference now to the drawings, and in particular to FIG. 1 thereof, the preferred embodiment of the new and improved apparatus for supporting a fluid and tape to be dispensed for sealing seams of wallboard panels embodying the principles and concepts of the present invention and generally designated by the reference numeral 10 will be described.

The present invention, the new and improved apparatus for supporting a fluid and tape to be dispensed for use in sealing seams of wallboard panels is comprised of a plurality of components. Such components in their broadest context include a bucket, tape, mechanisms for supporting the tape, a guide rod, blending fluid and a slot with associated components. Such components are individually configured and correlated with respect to each other so as to attain the desired objective.

More specifically, the system 10 of the present invention has as its central component a bucket 12. The bucket has a lower flat base 14 and upstanding generally cylindrical side walls 16. In addition, a handle 18 is rotatably secured with respect to the upper edge 20 of the bucket.

Located within the bucket 12 is a roll 15 of tape 17. Such roll and the supported tape is adapted to be retained within the bucket and dispensed therefrom as is need to carry out the desired objectives.

Also located within the bucket 12 are mechanisms 20. Such mechanisms are for supporting the roll of tape. Such support mechanisms include a central shaft 22. The central shaft is formed of two coaxial parts 24 and 26. A spring 28 is located within the common area of the two parts for urging the parts axially outwardly of the center thereof.

In association with such support mechanisms are a pair of upper bosses 32. Such bosses are secured to the interior surface 34 of the side wall of the bucket. They are located adjacent to the upper edge of the bucket and have centrally disposed apertures 36. Such apertures are for receiving the opposed ends 38 of the support rod. Such support is when the roll of tape is supported on a central extent of the support rod.

Also located within the bucket 12 is a guide rod 42. The guide rod is rotatably secured in a lower extent 44 of the bucket. The guide rod has opposed ends 46. A pair of lower bosses 48 are secured to the interior surface of the side wall of the bucket adjacent to the lower edge of the bucket. Apertures are formed in the lower bosses for receiving the opposed ends of the guide rod. The guide rod is positioned to receive and guide tape extending from the upper support rod to exterior of the bucket.

Also located within the bucket is a quantity of blending fluid 50. The blending fluid is preferably within the bucket to an elevation wherein its upper surface 52 is between the guide rod and the roll of tape.

The system functions for its intended purpose due to a slot 56 formed in a generally horizontal orientation in a position through a lower extent of the side wall of the bucket. The slot is at an elevational location essentially the same as that of the lower most edge of the guide rod. The slot has in association therewith, a support block 58 with an aperture 60 formed therein. The aperture is formed as an extension of the slot. The block is secured to the bucket on the exterior surface thereof.

The aperture also has exteriorly thereof a finger 64. Such finger is formed with the cutting edge 66 extending upwardly from beneath the aperture into the lower surface of the path of travel of a tape which is being fed through the slot and aperture.

The block also has in association therewith a brush 70. Such brush extends downwardly and is contactable with the upper surface of the path of travel of the tape being fed through the slot. The block functions for smoothing the blending fluid on the tape and for feeding the majority of the blending fluid. In this manner, the tape from a roll on the support rod may be fed therefrom and diverted by the guide rod and, in turn, directed into a horizontal path of travel through the slot and aperture. When required, the tape may be moved into contact with the cutting blade for separating from the roll the intended tape to be used. The path of travel also maintains the tape in contact with the brush for smoothing purposes.

The present invention is designed to dispense the tape used to seal and blend the seams of wallboard panels while simultaneously and automatically saturating the tape with the blending agent, commonly called "mud." It is comprised of a plastic bucket, two rollers, a dispensing block and associated hardware.

The bucket itself is conventional, except that four bosses are added to its interior surface. These bosses are arranged in directly opposed pairs with one pair near the wall of the bucket just below the top, and the other near the opposite wall just above the bottom. A rotating shaft is guided by each pair of bosses, and a roller is mounted on the lower shaft; the upper shaft is used to mount the roll of tape.

The dispensing block is mounted on the external surface of the bucket directly in line with the bottom of the roller mounted on the lower shaft. This block is 2 1/2 inches wide, 2 inches high and 1/4 inches thick, and a horizontally-oriented slot is cut through its center. The slot is straddled by a nylon bristle brush at its top and a sharp cutting edge at its bottom.

From the foregoing description, the use of the present invention becomes fairly obvious. The bucket is simply filled with mud to a level which is just below the roll of tape and the tape is fed through the slot in the dispensing block. As the tape is pulled through the slot, it will be saturated with mud, and when the desired length of tape has been extracted, a quick flip of the wrist will cut the tape at that length. The end of the tape which then rests on the cutting blade may then be grasped and pulled to repeat the procedure and provide the next desired length of tape. The alternative is manual manipulation of the tape roll and the independent application of mud, obviously a much more time-consuming and awkward task.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An apparatus for supporting a fluid and tape to be dispensed for sealing seams of wallboard panels comprising, in combination:

a bucket having a lower flat base and an upstanding generally cylindrical side wall with an upper edge, the bucket having a front portion and a rear portion, a handle being rotatably secured with respect to the upper edge thereof;

a roll of tape to be dispensed from the bucket;

mechanisms for supporting the roll of tape located in the rear portion of the bucket, such support mechanisms including a central shaft having opposed ends formed of two co-axial parts a first co-axial part including a bore with a spring housed therein, a second co-axial part being positioned within the bore abutting the spring, a pair of upper bosses secured to the interior surface of the side wall of the bucket adjacent to the upper edge thereof with apertures receiving the opposed ends of the central shaft, in an operative orientation the spring urging the parts axially outward within the bosses, the roll of tape being supported at the central extent of the central shaft, in an inoperative the user uncoupling the parts from the bosses by compressing the parts axially inward;

a guide rod located in the front portion of the bucket and rotatably secured in a lower extent thereof, the guide rod having opposed ends, a pair of lower bosses secured to the interior surface of the side wall of the bucket adjacent to the lower edge thereof with apertures receiving the opposed ends of the guide rod, the guide rod positioned to receive and guide tape extending from the central shaft;

a quantity of a blending fluid in the bucket to an elevation between the guide rod and roll of tape; and a slot in a generally horizontal orientation positioned through a lower extent of the side wall, the slot being at an elevational location essentially the same as that of the lower most edge of the guide rod, the slot having a support block with an aperture formed as an extension of the slot and secured to the bucket on the exterior surface thereof, the block having exteriorly thereof a finger formed with a cutting edge extending upwardly from beneath the aperture into the lower surface of the path of travel of tape being fed through the slot and aperture, the block also having a brush extending downwardly and contactable with the upper surface of the path of travel of the tape being fed through the slot for smoothing the blending fluid thereon.

* * * * *